US009650733B2

(12) United States Patent
Garland, III et al.

(10) Patent No.: US 9,650,733 B2
(45) Date of Patent: May 16, 2017

(54) SYSTEM AND METHOD FOR CREATING EMBROIDERED DECORATIVE ARTICLES

(71) Applicant: Action Tapes, Inc., Dallas, TX (US)

(72) Inventors: Roy Garland, III, Dallas, TX (US); Marvin Leon Gardner, Dallas, TX (US); Gary Allen Gardner, Dallas, TX (US)

(73) Assignee: Action Tapes, Inc., Dallas, TX (US)

( * ) Notice: Subject to any disclaimer, the term of this patent is extended or adjusted under 35 U.S.C. 154(b) by 70 days.

(21) Appl. No.: 14/739,389

(22) Filed: Jun. 15, 2015

(65) Prior Publication Data

US 2016/0319474 A1 Nov. 3, 2016

Related U.S. Application Data

(63) Continuation-in-part of application No. 14/699,371, filed on Apr. 29, 2015.

(51) Int. Cl.
*D05B 19/08* (2006.01)
*D05B 19/12* (2006.01)

(52) U.S. Cl.
CPC ..... *D05B 19/08* (2013.01); *D05B 19/12* (2013.01)

(58) Field of Classification Search
None
See application file for complete search history.

(56) References Cited

U.S. PATENT DOCUMENTS 6,196,146 B1 * 3/2001 Goldberg ..... D05B 19/10 112/102.5
6,216,618 B1 * 4/2001 Goldberg ..... D05B 19/02 112/102.5
8,069,091 B1 * 11/2011 Callen, Jr. ..... G06Q 30/0603 705/26.5
2004/0133296 A1 * 7/2004 Tomita ..... G06Q 30/0601 700/138
2005/0060058 A1 * 3/2005 Cameron ..... D05C 5/00 700/138
2005/0238251 A1 * 10/2005 Lunetta ..... G06T 11/60 382/284
2007/0198119 A1 * 8/2007 Bailie ..... D05B 19/08 700/138
2008/0079727 A1 * 4/2008 Goldman ..... G06T 11/60 345/441
2008/0147219 A1 * 6/2008 Jones ..... A43B 1/0054 700/95
2010/0106283 A1 * 4/2010 Harvill ..... D05C 5/04 700/138

(Continued)

*Primary Examiner* — Christopher E Everett
(74) *Attorney, Agent, or Firm* — Hubbard Johnston, PLLC

(57) ABSTRACT

A system and method for providing for the embroidery of articles which allows a user to select an article to be created from an article with one or more article pattern pieces, select or create and place a design to be embroidered on the selected pattern piece or pieces, render a two-dimensional image of the pattern with design thereon into a three-dimensional object depicting the design to be embroidered on the article, and generating a data file with instructions for embroidering the design or designs on the one or more article pattern pieces and/or with instructions for cutting the article pattern pieces from a fabric and embroidering the design on the article pattern pieces.

13 Claims, 5 Drawing Sheets

(56) References Cited

U.S. PATENT DOCUMENTS

| | | | | |
|---|---|---|---|---|
| 2014/0020191 | A1* | 1/2014 | Jones | A43B 3/0084<br>12/142 R |
| 2014/0277663 | A1* | 9/2014 | Gupta | G06F 17/50<br>700/98 |
| 2015/0066189 | A1* | 3/2015 | Mulligan | G06F 3/04815<br>700/136 |

* cited by examiner

SYSTEM AND METHOD FOR CREATING EMBROIDERED DECORATIVE ARTICLES

CROSS-REFERENCE TO RELATED APPLICATIONS

This application is a continuation-in-part application and claims the benefit of and priority to co-pending U.S. patent application Ser. No. 14/699,371 filed on Apr. 29, 2015, the disclosure of which is hereby incorporated by reference.

TECHNICAL FIELD

The illustrative embodiments relate generally to the embroidery of articles, and more particularly, to a system and method for which allows a user to select an article to be created from a pattern, place a design to be embroidered on the selected pattern, render a two-dimensional image of the pattern with design thereon into a three-dimensional object depicting the design to be embroidered on the article, and generating a data file with instructions for cutting the article pattern pieces from a fabric and embroidering the design on the article.

BACKGROUND

Articles, such as clothing items, fabrics, upholstery, and coverings for use in a variety of applications, may be embroidered with a design or other embellishment so that such article comprises a unique article. Creating an article with a unique or custom design or image requires one to plan and dimension the design to be embroidered on the article pattern pieces and attempt to translate and visualize that design from a two-dimensional (2D) drawing of the pattern pieces into a three-dimensional (3D) rendering of the article with the design. This generally requires the investment of a substantial amount of time and mental effort, along with a solid understanding of dimensional mathematics and related measuring skills, to properly translate and position the design on a 2D pattern which will result in the desired appearance and location of the design to be embroidered on the article. A simple miscalculation or mistake in placing the location of the design on one or more pattern pieces making up the article pattern will certainly alter the desired location and/or appearance of the design embroidered on the article which would then require one to start the process all over again with new materials. Other inconveniences and problems may be encountered when embroidering a 2D design on to an article that lead to inaccurate sizing, orientation of the design on the article or errors in the creation of the pattern for making the article with design embroidered thereon.

SUMMARY

According to an embodiment, a computer implemented method for creating an article to be embroidered with a desired design comprises the steps of: selecting an article, wherein the article comprises one or more pattern pieces that form the article; creating a unique design, or selecting an existing design, to be embroidered on one or more pattern pieces; positioning the design or designs on the one or more pattern pieces; rendering the one or more pattern pieces into a three-dimensional object depicting the article with the one or more designs to be embroidered on the article a user interface display.

According to another illustrative embodiment, a computer program product in a computer readable medium for use in creating and embroidering an image or design on an article, the computer program product comprises: instructions for selecting an article, wherein the article comprises one or more pattern pieces that form the article; instructions for creating a unique design or selecting a pre-loaded design to be embroidered on one or more pattern pieces; instructions for positioning the design or designs on the one or more pattern pieces; instructions for rendering the one or more pattern pieces into a three-dimensional object depicting the article with the one or more designs to be embroidered on the article with a user interface display, and generating instructions for creating a data file with embroidery instructions and/or cutting instructions for embroidering and/or cutting the one or more pattern pieces from one or more sheets of fabric, textile or material.

DETAILED DESCRIPTION

In the following detailed description of the illustrative embodiments, reference is made to the accompanying drawings that form a part hereof. These embodiments are described in sufficient detail to enable those skilled in the art to make and practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those of skill in the art. The following written description is, therefore, not to be taken in a limiting sense, and the scope of the illustrative embodiments are defined only by the appended claims.

Figure 1:
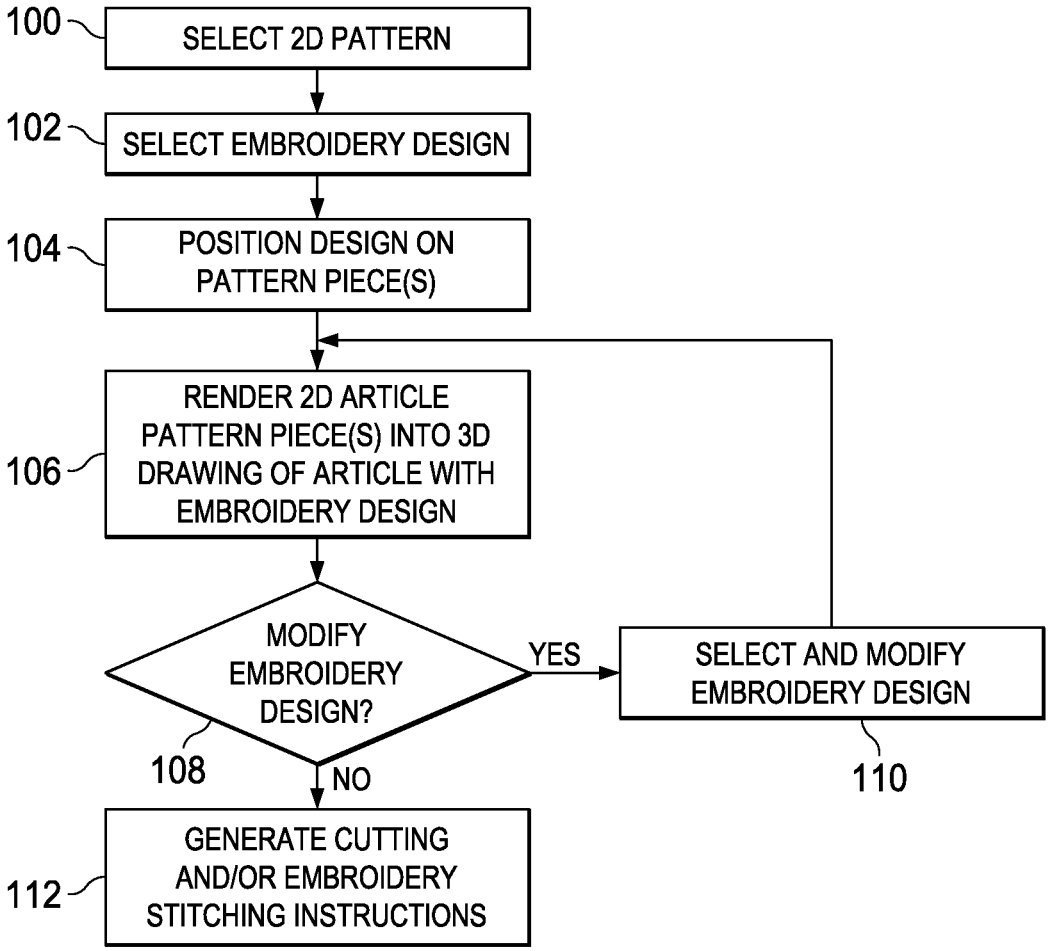
FIG. 1 is a flow chart depicting the method for creating embroidered decorative apparel according to an embodiment of the invention described herein.

Turning to FIG. 1, the sequence of steps (100-112) will be illustrated in the context of a method for creating instructions for a design to be embroidered on an article as described herein. Unless otherwise noted, the method may be performed by any suitable device such as a computer, an embroidery machine, a fabric cutting machine, a computer in communication with the one or more of an embroidery machine or a fabric cutting machine, or any other suitable device or combination of devices. The user is prompted to select an article pattern (with corresponding pattern pieces) that are displayed in a 2D rendering on a graphical user interface (GUI) which is in electronic communication with a computer, an embroidery machine, a fabric cutting machine, a computer in communication with the one or more of an embroidery machine or a fabric cutting machine, or any other suitable device or combination of devices. (Step 100). After selecting the desired article, the user then selects a design to be embroidered on the article (Step 102). Next, the user then positions the design at desired locations on the one or more pattern pieces (Step 104) as displayed on the user GUI. Next, the pattern pieces depicted in 2D are electronically rendered into a 3D object displayed on the user GUI depicting the pattern pieces in an assembled 3D object form that allows the user to view the article with the design or designs in the location and orientation on the article specified by the user and as the design or designs will be embroidered on the article (Step 106). If the user wishes to reposition or modify the one or more designs depicted on the article displayed in the user GUI (Step 108), the user may then modify, remove, reposition, enlarge, shrink, or otherwise manipulate the design on one or more pattern pieces, or may select a new design to be embroidered on the article (Step 110) and a new 3D rendering of the modified article depicted with design depicted thereon is presented on the display to the user. The method allows the user to continue to modify the design displayed on the article until the user is satisfied with the appearance of the article and design or designs thereon. Once the user is satisfied with the article and design thereon, the user acknowledges the design is complete and cutting and/or embroidery stitching instructions are generated (Step 112). The user may store the electronic instruction files and image files on a computer, an embroidery machine, a fabric cutting machine, a computer in communication with the one or more of an embroidery machine or a fabric cutting machine, or any other suitable device or combination of devices as electronic files which may used by automated embroidery and fabric cutting equipment to create the article and embroidery the design on the article as created by the user.

The user GUI may use commonly known graphical user interfaces devices which are broadly construed herein to include and mean any graphical, audio, video, or other media display or sensing system for communicating digital or analog input and/or output of one or more programs or functions, such as presenting icons of objects, buttons or selections, dialog boxes or windows, toolsets, displaying two-dimensional (2D) and three-dimensional (3D) renderings of visual objects, articles, pattern pieces and other audio visual information on the screen of the GUI. The GUI is configured to receive, display and transmit information that allows the user to practice the method and system described herein. In an embodiment, the article may be displayed on the GUI in 3D along with a body profile of a male or female person, animal, furniture piece or other object for which the article is to be utilized or worn. In another embodiment, the user may select or upload one or more designs or design files to a software application or other modality. Multiple users may access the same article information and templates, however each user may customize or tailor each article template with a design the user selects for display and embroidering on the article as described herein. Users may modify the article sizing to their personal desired size and dimensions.

Figure 2A:
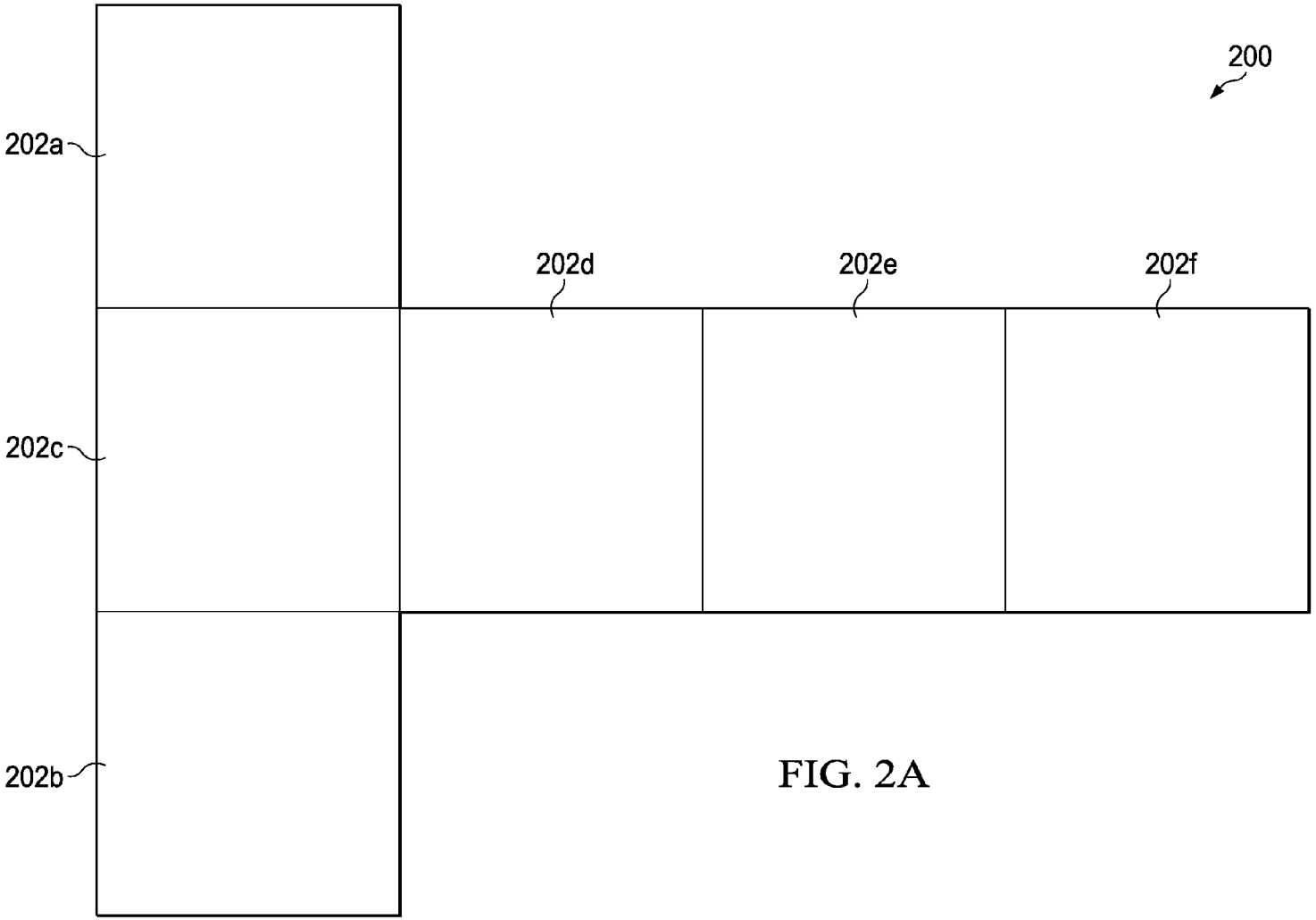
FIG. 2A depicts pattern pieces for an article according to an embodiment of the invention described herein.

Referring to FIG. 2A, an illustrative embodiment 200 is shown for a cube shape article presented in a 2D rendering upon which a user desires to have a design or multiple designs embroidered thereon. It will be appreciated that the particular article 200 is used for illustrative purposes only and that any suitable article or article pattern pieces may be employed and remain within the scope of the present disclosure. Article 200 comprises one or more pattern pieces (202*a*-202*f*) which may be sewn, stitched or otherwise coupled together to form the article 200. It will be appreciated that article 200 may comprise one or more pattern pieces (202*a*-202*f*) of different fabrics or materials and remain within the scope of the invention. Once the user has selected the desired article 200 which is displayed on the user GUI in a 2d rendering, the user then proceeds to select a design or designs which are to be embroidered on the article 200 and positioned on one or more article pattern pieces as shown in FIG. 2B.

Figure 2B:
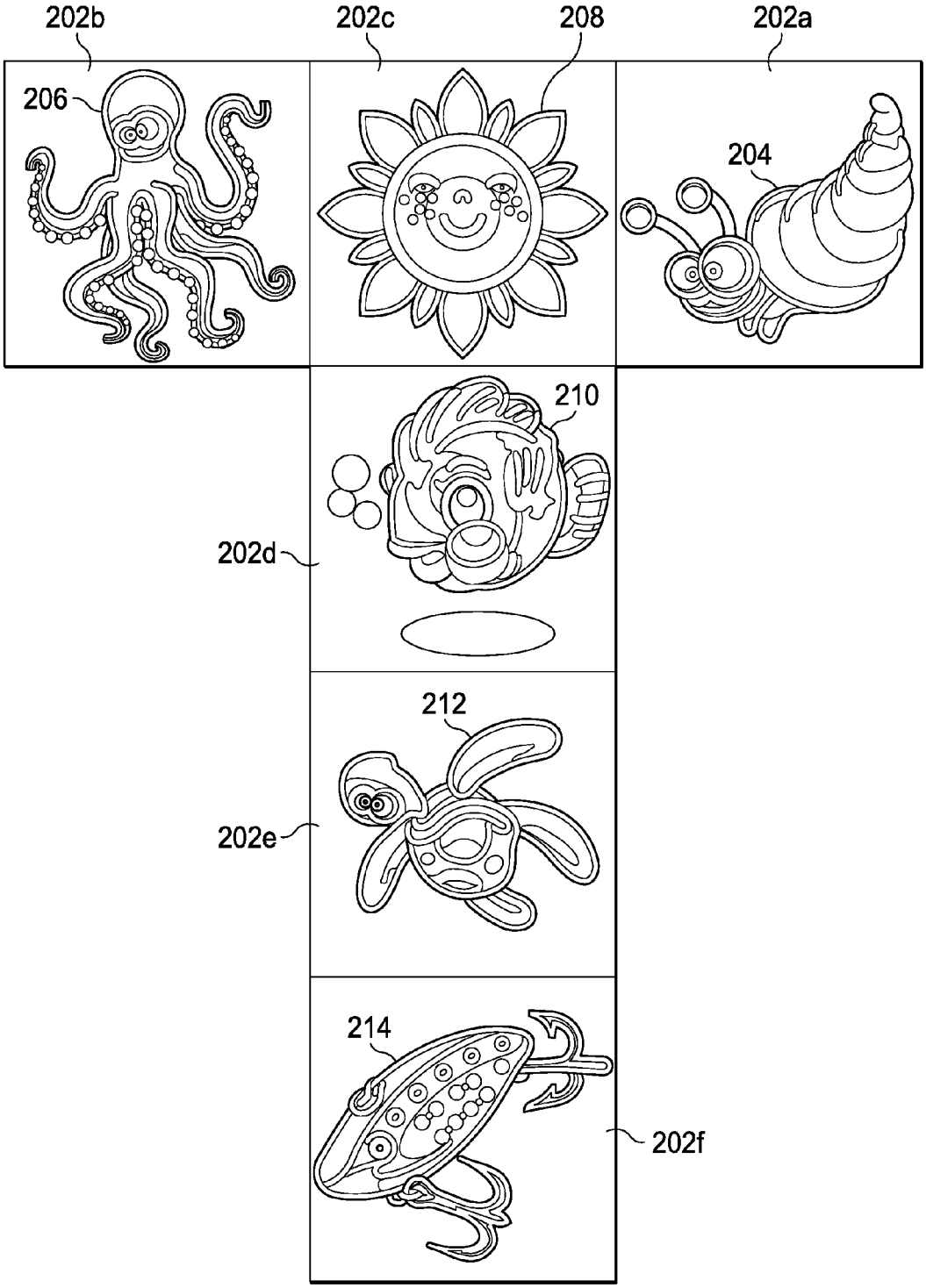
FIG. 2B shows various pattern pieces with a desired design selected and positioned on article pattern pieces by the user according to an embodiment of the invention described herein.

As depicted in FIG. 2B, the user positions one or more designs (204, 206, 208, 210, 212) to be embroidered on the one or more corresponding article pattern pieces (202*a*-202*f*) as selected and positioned by the user. The designs (204-212) may be selected from pre-loaded image or design files or may be created as a custom design by the user with software design tools as are known in the art. As shown in the depicted embodiment, a bee design 204 is shown positioned on article pattern piece 202*a*, a sun design 208 is shown positioned on article pattern piece 202*c*, an octopus design 206 is shown positioned on article pattern piece 202*b*, a fish design 210 is shown depicted on article pattern piece 202*d*, a turtle design 212 is shown depicted on article pattern piece 202*e*, and a fishing lure 214 is shown depicted on article pattern piece 202*f*. The article pattern pieces (202*a*-202*f*) with corresponding designs (204-212) depicted thereon are displayed in a 2D rendering on the user GUI as shown in FIG. 2B.

Figure 2C:
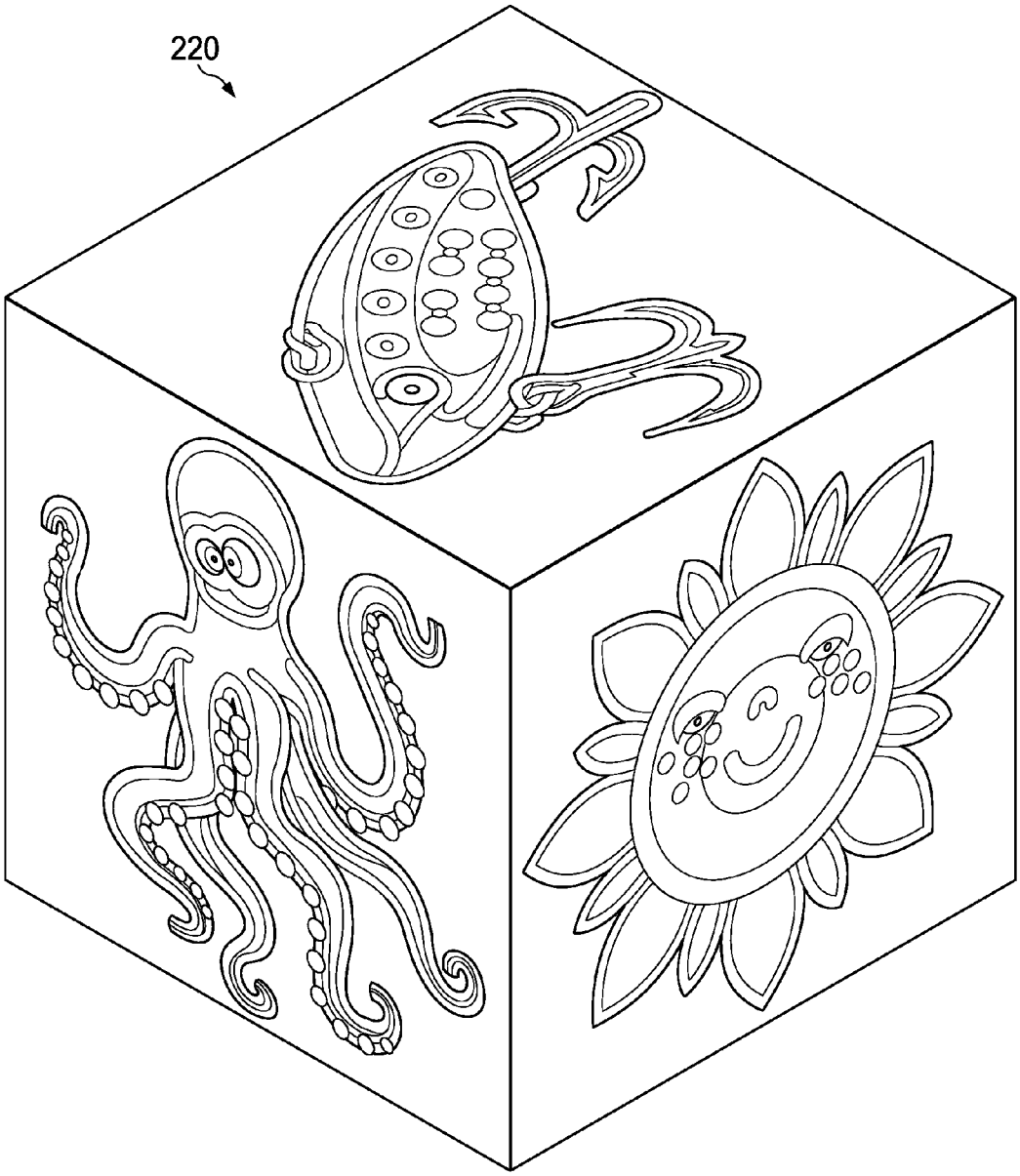
FIG. 2C shows the article pattern pieces rendered as a three-dimensional article with the design or designs in the desired positions and orientation on the article; and, FIG. 3 depicts a schematic block diagram of a data processing system in which the illustrative embodiments may be implemented.

Turning to FIG. 2C, the article pattern pieces (202*a*-202*f*) with corresponding designs (204-212) depicted thereon are rendered into a 3D object displayed on the user GUI as shown in FIG. 2C. FIG. 2C shows the article pattern pieces in an assembled form depicting a 3D rendering of the assembled article 220 with corresponding designs depicted thereon in the orientation and dimensions in which designs (204-212) would be embroidered on article pattern pieces (202*a*-202*f*). If the user desires to modify one or more of the designs (202*a*-202*f*) on one or more article pattern pieces (202*a*-202*f*), the user utilizes the user GUI to select and modify the desired design or designs (204-212) that will be embroidered on article pattern pieces (202*a*-202*f*) and the resulting modifications are rendered into a modified 3D object of the article with design or designs depicting the modifications made by the user.

Once the user is satisfied with the article 200 and the designs (204-212) to be embroidered thereon as shown in the 3D rendering on the user GUI, instructions for embroidering the selected designs (204-212) on the article pattern pieces (202*a*-202*f*) are generated. The embroidery instructions may take any suitable form. For example, the embroidery instructions may be an electronic file, or machine readable file, for use by an embroidery machine such that the embroidery machine may be instructed to sew or stitch the selected design or designs on one or more sheets of fabric, other textile or material. The embroidery instructions may include instructions for marking a template on one or more sheets of fabric, other textile or material for a user to follow in order to embroider the design(s) on the pattern pieces by hand. In one embodiment, instructions for cutting the pattern pieces (202*a*-202*f*) may be generated. The cutting instructions may be an electronic file, or machine readable file, for use by an embroidery machine such that the embroidery machine may be instructed to sew, stitch or otherwise mark a template on one or more sheets of fabric, textile or other material for a user to follow in order to cut out the article pattern pieces by hand.

Figure 3:
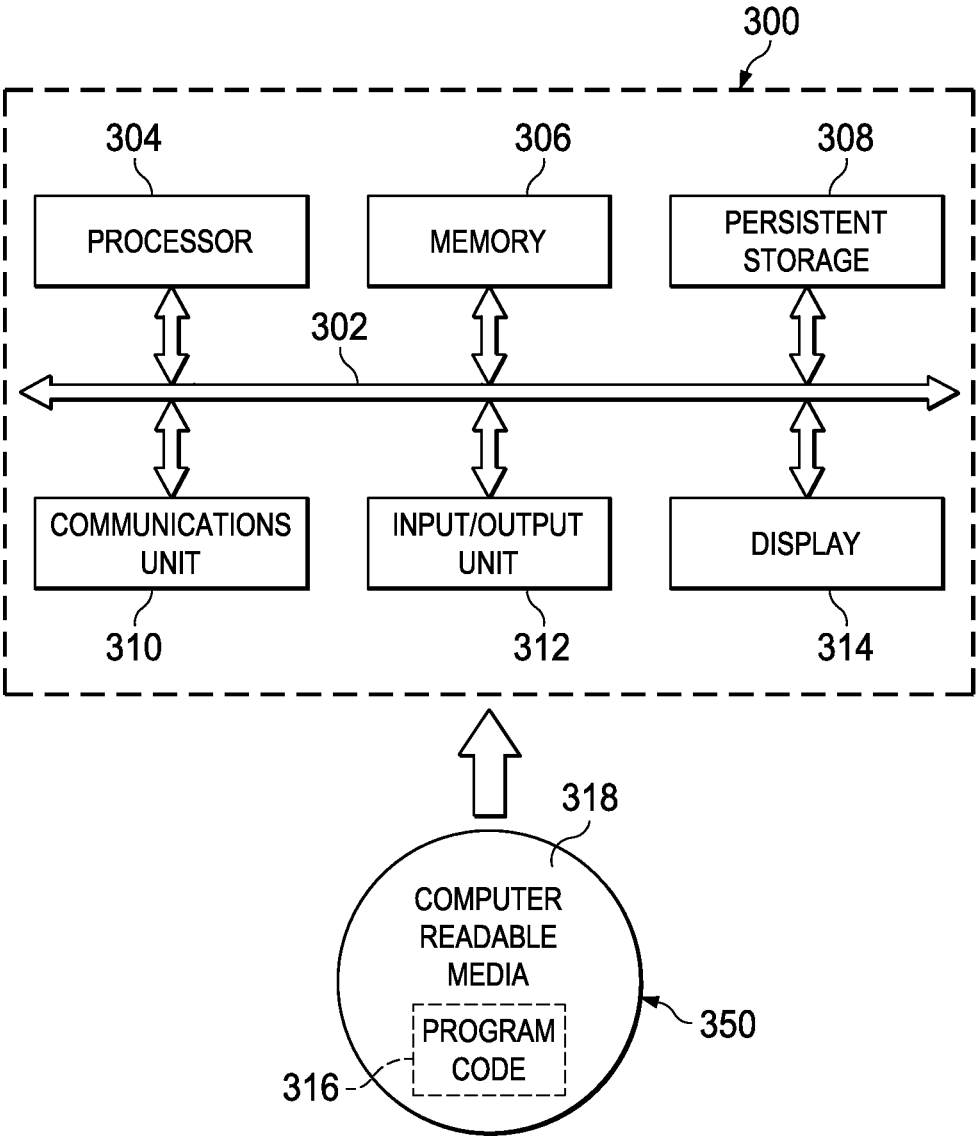

Referring now to FIG. 3, a block diagram of a computing device 300 is shown in which the illustrative embodiments may be implemented. The computing device 300 may be a computer, a user GUI, or any other suitable device or combination of devices. Computer-usable program code or instructions implementing the processes used in the illustrative embodiments may be located on the computing device 300. The computing device 300 includes a communications fabric 302, which provides communications between a processor unit 304, a memory 306, a persistent storage 308, a communications unit 310, an input/output (I/O) unit 312, and a display 314.

The processor unit 304 serves to execute instructions for software that may be loaded into the memory 306. The processor unit 304 may be a set of one or more processors or may be a multi-processor core, depending on the particular implementation. Further, the processor unit 304 may be implemented using one or more heterogeneous processor systems in which a main processor is present with secondary processors on a single chip. As another illustrative example, the processor unit 304 may be a symmetric multi-processor system containing multiple processors of the same type.

The memory 306, in these examples, may be, for example, a random access memory or any other suitable volatile or non-volatile storage device. The persistent storage 308 may take various forms depending on the particular implementation. For example, the persistent storage 308 may contain one or more components or devices. For example, the persistent storage 308 may be a hard drive, a flash memory, a rewritable optical disk, a rewritable magnetic tape, or some combination of the above. The media used by the persistent storage 308 also may be removable. For example, a removable hard drive may be used for the persistent storage 308.

The communications unit 310, in these examples, provides for communications with other data processing systems or communication devices. In these examples, the communications unit 310 may be a network interface card. The communications unit 310 may provide communications through the use of either or both physical and wireless communication links.

The input/output unit 312 allows for the input and output of data with other devices that may be connected to the computing device 300 and which may be connected to a network. For example, the input/output unit 312 may provide a connection for user input through a keyboard and mouse. Further, the input/output unit 312 may send output to a processing device. In the case in which the computing device 300 is a cellular phone, the input/output unit 312 may also allow devices to be connected to the cellular phone, such as microphones, headsets, and controllers. The display 314 provides a mechanism to display information to a user, such as a GUI as described herein.

Instructions for the operating system and applications or programs are located on the persistent storage 308. These instructions may be loaded into the memory 306 for execution by the processor unit 304. The processes of the different embodiments may be performed by the processor unit 304 using computer-implemented instructions, which may be located in a memory, such as the memory 306. These instructions are referred to as program code, computer-usable program code, or computer-readable program code that may be read and executed by a processor in the processor unit 304. The program code in the different embodiments may be embodied on different physical or tangible computer-readable media, such as the memory 306 or the persistent storage 308.

Program code 316 is located in a functional form on a computer-readable media 318 and may be loaded onto or transferred to the computing device 300 for execution by the processor unit 304. The program code 316 and the computer-readable media 318 form computer program product 350 in these examples. In one embodiment, the computer program product 350 is an application or program module encompassing the methods described herein. In this embodiment, the program code 316 may include computer-usable program code capable of selecting an article pattern from a user. The program code 316 may also include computer-usable program code capable of creating, selecting and/or modifying a design or multiple designs to be embroidered on one or more article pattern pieces displayed on a user GUI. The program code 316 may also include computer-usable program code capable of directing a user to position a pre-existing design or multiple designs on to one or more article pattern pieces depicted on a user GUI. The program code 316 may also include computer-usable program code capable of rendering one or more 2D article pattern pieces into a 3D object image of an article with design depicted on a user GUI. The program code 316 may also include computer-usable program code capable of allowing a user to modify, reposition or manipulate the design or multiple designs on one or more pattern pieces displayed in the 3D rendering. The program code 316 may also include computer-usable program code capable of generating instructions for embroidering and/or cutting a fabric, textile or other material to form and create the article with design or multiple designs thereon. The program code 316 may also include computer-usable program code capable of directing the user to embroider and/or cut the article pattern pieces with the design or designs, or otherwise transmit instructions to another user, a manufacturer or to machine equipment for producing the article with design. Any combination of the above-mentioned computer-usable program code may be implemented in the program code 316, and any functions of the illustrative embodiments may be implemented in the program code 316.

In one example, the computer-readable media 318 may be in a tangible form, such as, for example, an optical or magnetic disc that is inserted or placed into a drive or other device that is part of the persistent storage 308 for transfer onto a storage device, such as a hard drive that is part of the persistent storage 308. In a tangible form, the computer-readable media 318 also may take the form of a persistent storage, such as a hard drive or a flash memory that is connected to the computing device 300. The tangible form of the computer-readable media 318 is also referred to as computer recordable storage media.

Alternatively, the program code 316 may be transferred or deployed to the computing device 300 from the computer-readable media 318 through a communication link to the communications unit 310 or through a connection to the input/output unit 312. The communication link or the connection may be physical or wireless in the illustrative examples. The computer-readable media 318 also may take the form of non-tangible media, such as communication links or wireless transmissions containing the program code 316. In one embodiment, the program code 316 is delivered to the computing device, the embroidery machine, or cutting equipment 300 over the Internet.

The different components illustrated for the computing device 300 are not meant to provide architectural limitations to the manner in which different embodiments may be implemented. The different illustrative embodiments may be implemented in a data processing system including components in addition to or in place of those illustrated for computing device 300. Other components shown in FIG. 3 can be varied from the illustrative examples shown.

As one example, a storage device in the computing device 300 is any hardware apparatus that may store data. The memory 306, the persistent storage 308, and the computer-readable media 318 are examples of storage devices in a tangible form. In another example, a bus system may be used to implement the communications fabric 302 and may be comprised of one or more buses, such as a system may be implemented using any suitable type of architecture that provides for a transfer of data between different components or devices attached to the bus system. Additionally, the communications unit 310 may include one or more devices used to transmit and receive data, such as modem or a network adapter. Further, a memory may be, for example, the memory 306 or a cache such as found in an interface and memory controller hub that may be present in the communications fabric 302.

Although the illustrative embodiments described herein have been disclosed in the context of certain illustrative, non-limiting embodiments, it should be understood that various changes, substitutions, permutations, and alterations can be made without departing from the scope of the invention as defined by the appended claims. It will be appreciated that any feature that is described in a connection to any one embodiment may also be applicable to any other embodiment.

We claim:

1. A computer-implemented method for creating a custom design on an article from an embroidery application software, comprising:

selecting an article having a plurality of article pattern pieces, wherein each of the plurality of article pattern pieces is substantially two-dimensional, the article configured to form a three-dimensional object when assembled having a plurality of sides, the plurality of article pattern pieces to be embroidered on at least two article pattern pieces;

selecting a first embroidery design to be embroidered on at least one article pattern piece of the plurality of article pattern pieces;

selecting a second embroidery design to be embroidered on at least another of the plurality of article pattern pieces;

editing the location of the first embroidery design on the at least one article pattern piece of the plurality of article pattern pieces;

rendering the plurality of article pattern pieces into a three-dimensional object depicting the first embroidery design and second embroidery design embroidered on the article, wherein the first embroidery design and the second embroidery design are on different sides of the three-dimensional object; and, generating instructions for embroidering the first embroidery design and the second embroidery design on the plurality of article pattern pieces.

2. The method of claim 1 further comprising:

outputting generated embroidery instructions from the step of generating instructions for embroidering the first embroidery design and second embroidery design on the plurality of article pattern pieces in a machine readable format for an embroidery machine.

3. The method of claim 1 further comprising:

modifying the first embroidery design or second embroidery design on the plurality of article pattern pieces.

4. The method of claim 1 wherein the article is one from the group consisting of clothing, headwear, footwear, furniture, upholstery, fabrics, and toys.

5. The method of claim 1 further comprising:

generating instructions for cutting the plurality of article pattern pieces.

6. A method, comprising the steps of:

selecting an article with a computer, wherein the article when assembled forms a three-dimensional object and comprises a plurality of article pattern pieces, wherein each of the plurality of article pattern pieces is substantially two dimensional;

positioning a first embroidery design on one of the plurality of article pattern pieces with the computer;

positioning a second embroidery design on another of the plurality of article pattern pieces with the computer;

wherein the first embroidery design and second embroidery design are on different sides of the three-dimensional object that is formed when the article is assembled;

rendering the plurality of article pattern pieces for the article with the computer, wherein the rendering results in the depiction of the assembled article as a three-dimensional object showing the article with the first embroidery design and second embroidery design on the article; and, generating embroidery instructions with the computer for embroidering the first embroidery design and second embroidery design on the plurality of article pattern pieces.

7. The method of claim 6 further comprising modifying the first embroidery design to be embroidered on the plurality of article pattern pieces.

8. The method of claim 7 wherein the modifying step includes re-sizing the first embroidery design, reorienting the first embroidery design, recoloring, or adding or deleting portions of the first embroidery design located on the plurality of article pattern pieces.

9. The method of claim 6 further comprising:

storing the article with the first embroidery design and second embroidery design depicted on the article in an electronic medium.

10. The method of claim 6 further comprising:

generating cutting instructions with the computer for cutting the plurality of article pattern pieces from a sheet of fabric, textile or material.

11. The method of claim 10 further comprising:

transmitting instructions for cutting the plurality of article pattern pieces for the article.

12. The method of claim 6 further comprising:

transmitting instructions for embroidering the first embroidery design and second embroidery design as depicted in the rendering step onto the plurality of article pattern pieces.

13. The method of claim 6 further comprising:

outputting generated embroidery instructions from the step of generating embroidery instructions with the computer for embroidering the first embroidery design and second embroidery design on the plurality of article pattern pieces in a machine readable format for an embroidery machine.

* * * * *